US009637137B2

(12) United States Patent
Park

(10) Patent No.: US 9,637,137 B2
(45) Date of Patent: May 2, 2017

(54) HANGER TROLLEY SYSTEM

(71) Applicant: HYUNDAI MOTOR COMPANY, Seoul (KR)

(72) Inventor: Sang Kyu Park, Seongnam-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 210 days.

(21) Appl. No.: 14/558,524

(22) Filed: Dec. 2, 2014

(65) Prior Publication Data

US 2016/0090106 A1 Mar. 31, 2016

(30) Foreign Application Priority Data

Sep. 30, 2014 (KR) ..... 10-2014-0131614

(51) Int. Cl.
*B61B 10/02* (2006.01)

(52) U.S. Cl.
CPC ..... *B61B 10/022* (2013.01); *B61B 10/025* (2013.01)

(58) Field of Classification Search
CPC .. B61B 3/00; B61B 3/02; B61B 10/00; B61B 10/02; B61B 10/022; B61B 10/025; B61B 13/00; B61B 13/12
See application file for complete search history.

(56) References Cited

U.S. PATENT DOCUMENTS 4,939,999 A 7/1990 Burt et al.
6,604,279 B2 8/2003 Kurtz

FOREIGN PATENT DOCUMENTS

JP 2000-016559 A 1/2000
KR 10-2005-0098669 A 10/2005
KR 20050098669 * 12/2005 ..... B62D 65/18
KR 10-2006-0118691 A 11/2006
KR 10-2007-0038624 A 4/2007
KR 10-2014-0058024 A 5/2014

* cited by examiner

*Primary Examiner* — R. J. McCarry, Jr.
(74) *Attorney, Agent, or Firm* — McDermott Will & Emery LLP

(57) ABSTRACT

A hanger trolley system includes: a driving chain provided in a power rail; a hanger trolley including a hanger dog attached to and detached from a chain dog provided in the driving chain and moving along a free rail formed below the power rail; and a sensor confirming coupling between the chain dog and the hanger dog. A coupled state between the chain dog provided in the driving chain and the hanger dog provided in the hanger trolley is confirmed through the sensor, such that judgment on succession when the hanger trolley is succeeded from a pre-process driving chain to a post-process driving chain becomes clearer as compared with the related art.

7 Claims, 6 Drawing Sheets

HANGER TROLLEY SYSTEM

CROSS-REFERENCE TO RELATED APPLICATION

This application is based on and claims the benefit of priority to Korean Patent Application No. 10-2014-0131614, filed on Sep. 30, 2014 in the Korean Intellectual Property Office, the disclosure of which is incorporated herein in its entirety by reference.

TECHNICAL FIELD

The present disclosure relates to a hanger trolley system, and more particularly, to a hanger trolley system capable of confirming a coupled state between a chain dog provided in a driving chain and a hanger dog provided in a hanger trolley through a sensor.

BACKGROUND

As shown in FIG. 1, a trolley system according to the related art has judged whether or not succession has been conducted based on manipulation timings of switches 6 each provided in a chain dog 4 and a hanger dog 5 when a hanger 1 is succeeded from a pre-process driving chain 2 to a post-process driving chain 3.

However, in a technology of judging the succession through the manipulation timing of the switches according to the related art, the judgment on the succession will be disturbed due to a malfunction, so a timing delay of the switches and non-conducting of the succession may occur, which may separate the hanger from the driving chain.

SUMMARY

The present disclosure has been made to solve the above-mentioned problems occurring in the prior art while advantages achieved by the prior art are maintained intact.

An aspect of the present disclosure provides a hanger trolley system capable of preventing succession from being not generated when a hanger is succeeded from a pre-process driving chain to a post-process driving chain by confirming a coupled state between a chain dog provided in a driving chain and a hanger dog provided in a hanger trolley through a sensor.

According to an exemplary embodiment of the present disclosure, a hanger trolley system includes: a driving chain provided in a power rail; a hanger trolley including a hanger dog attached to and detached from a chain dog provided in the driving chain and moving along a free rail formed below the power rail; and a sensor confirming coupling between the chain dog and the hanger dog.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
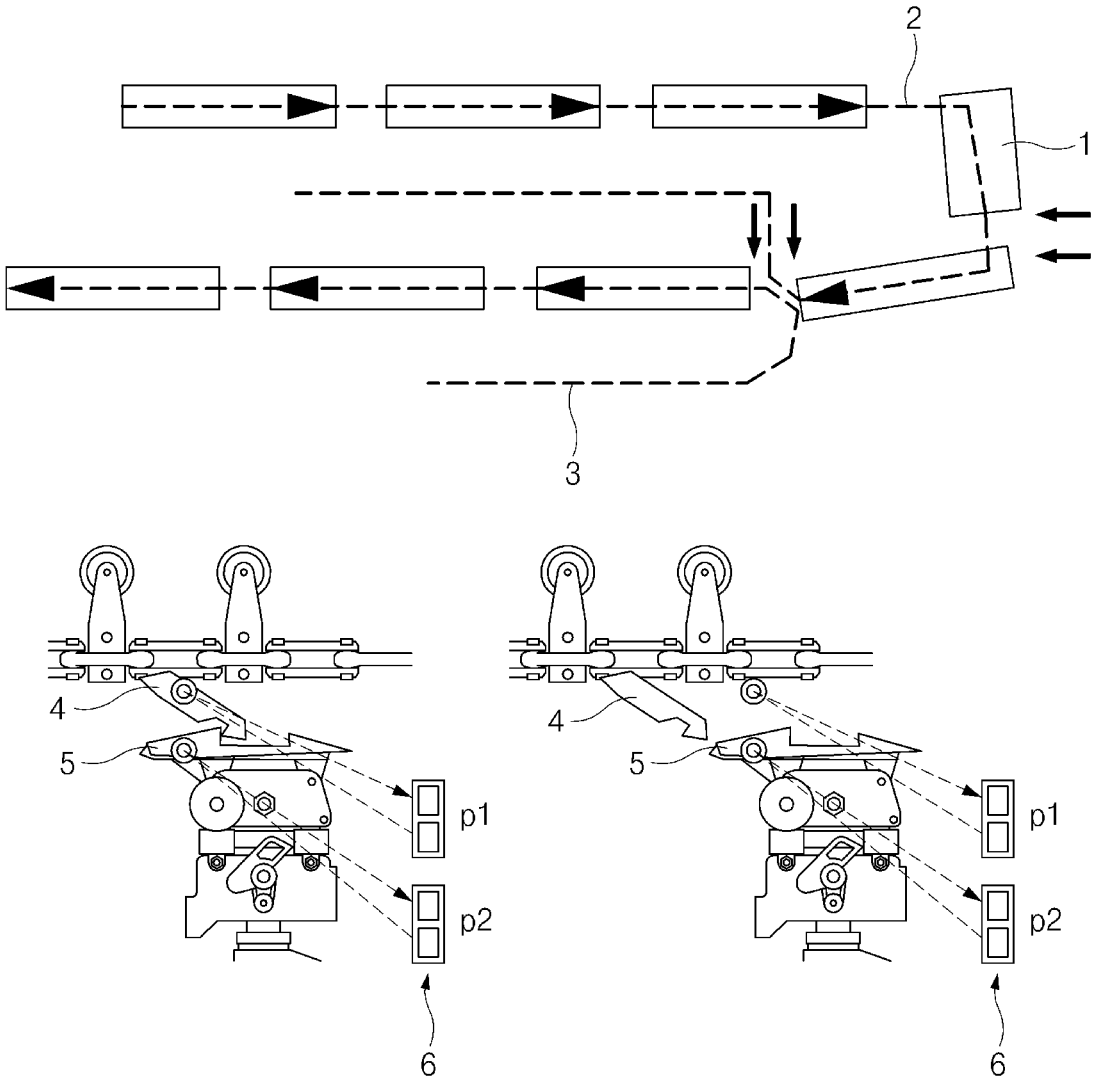
Fig.1 Prior Art
FIG. 1 is a schematic view of a trolley system according to the related art.
Figure 2:
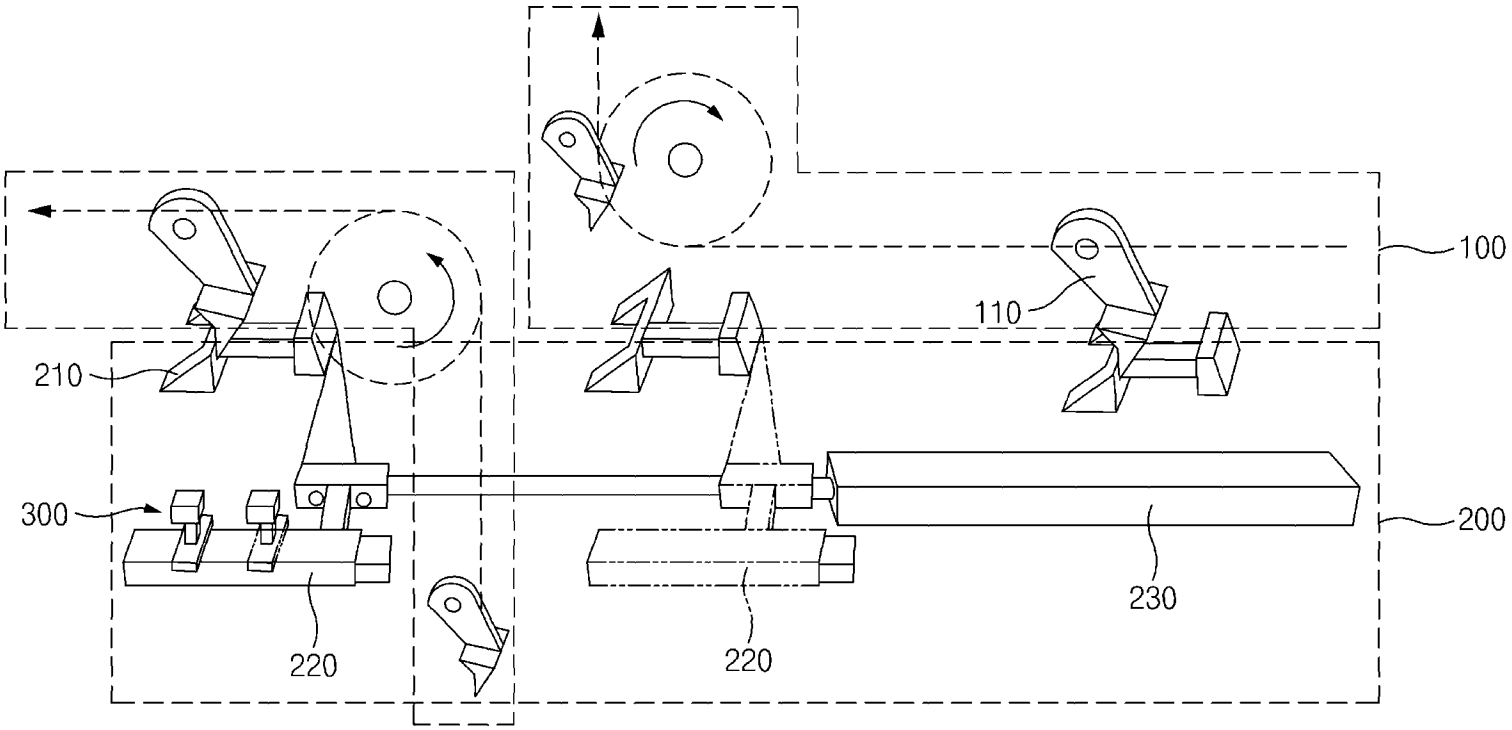
FIG. 2 is a schematic view of a hanger trolley system according to an exemplary embodiment of the present disclosure.

An exemplary embodiment of the present disclosure will be described in detail with reference to the accompanying drawings.

As shown in FIGS. 2 to 5, a hanger trolley system according to an exemplary embodiment of the present disclosure includes a driving chain 100 provided in a power rail, a hanger trolley 200 including a hanger dog 210 attached to and detached from a chain dog 110 provided in the driving chain 100 and moving along a free rail formed below the power rail, and a sensor 300 confirming coupling between the chain dog 110 and the hanger dog 210.

A hanger feeder 230 pushing the hanger trolley 200 from a pre-process power rail to a post-process power rail includes the sensor 300 and a linear module 220. The liner module 220 is in parallel with the free rail and is positioned at one side of the hanger trolley 200. More specifically, the linear module 220 extends from the hanger feeder 230. The hanger feeder 230 is positioned at an intersection point between the pre-process power rail and the post-process power rail.

The sensor 300 may include a laser vision camera (not shown) photographing the chain dog 110 and the hanger dog 210 and an acceleration sensor 300 measuring a moving speed of the hanger trolley 200. The laser vision camera may be replaced with any camera, image capture device or the like. The hanger trolley system according to an exemplary embodiment of the present disclosure further includes a controller (not shown) receiving measured signals from the laser vision camera and the acceleration sensor and transmitting a signal to a power source moving the driving chain 100.

Figure 3:
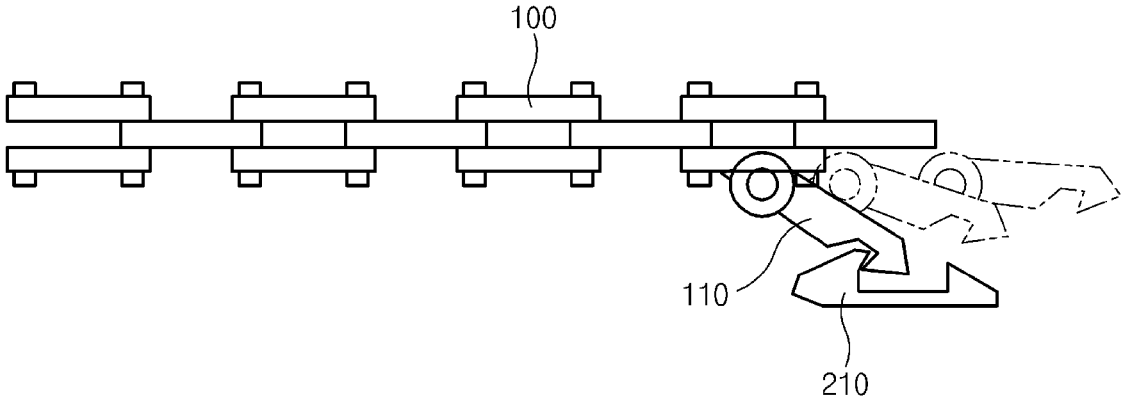
FIG. 3 is a view showing a coupling motion of a chain dog provided in the hanger trolley system of FIG. 2.
Figure 4:
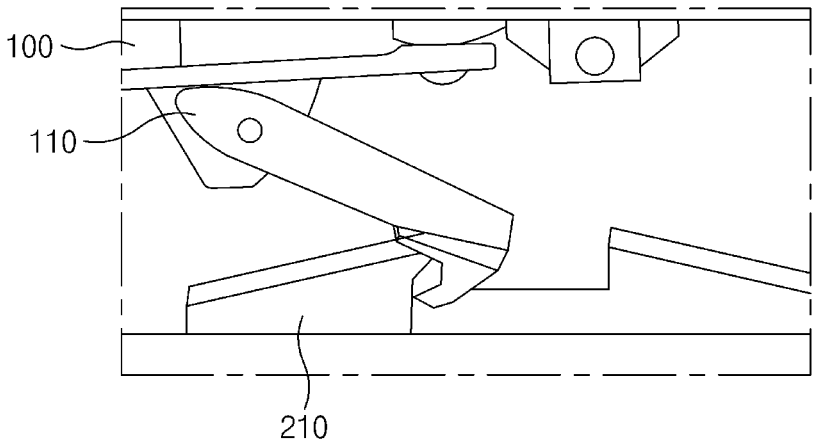
FIG. 4 is a view illustrating an operation of a sensor provided in the hanger trolley system of FIG. 2.
Figure 4:
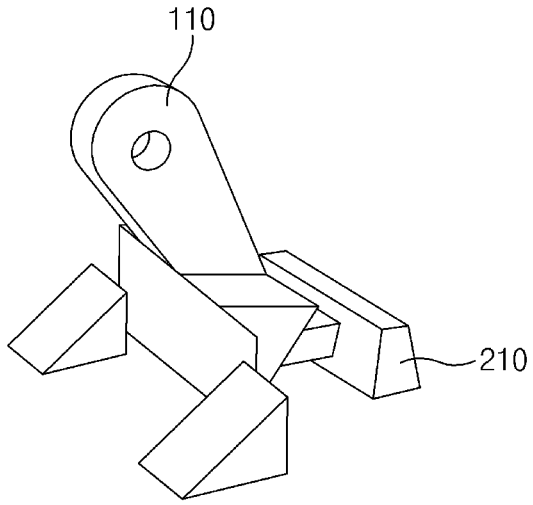

The laser vision camera senses whether abnormality is present in a coupling motion of the chain dog 110 as shown in FIG. 3 to sense abnormality of succession. In addition, as shown in FIG. 4, the laser vision camera analyzes a laser profile to recognize a coupling state after coupling between the chain dog 110 and the hanger dog 210 is completed, thereby sensing the abnormality of the succession. Here, it is preferable that the coupled state between the chain dog 110 and the hanger dog 210 is three-dimensionally analyzed.

In addition, a moving direction of the hanger trolley 200 is sensed and tracked through the acceleration sensor mounted on the linear module 220, thereby judging whether the succession has been normally conducted.

The power rail includes the pre-process power rail handing over the hanger trolley 200 and the post-process power rail taking over the hanger trolley 200. The hanger trolley 200 includes the hanger feeder 230 pushing the hanger trolley 200 from the pre-process power rail to the post-process power rail. The hanger feeder 230 pushes the hanger trolley 200 so that the hanger dog 210 is separated from the chain dog 110.

Figure 6:
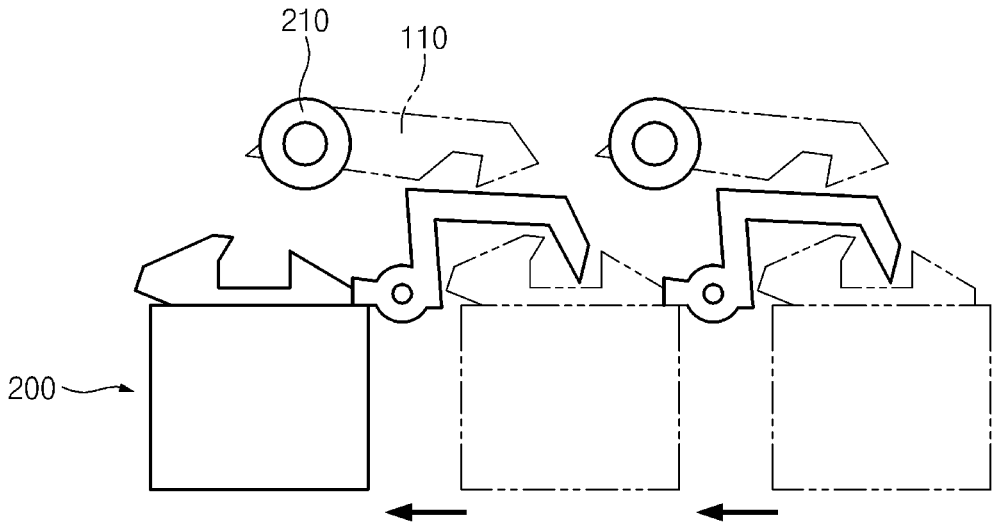
FIG. 6 is a view illustrating abnormal forward movement.

In the case in which a plurality of hanger trolleys 200 are arranged at the same interval and are connected to each other as shown in FIG. 6, it is difficult to couple the chain dog 110 and the hanger dog 210 to each other as the hanger trolleys 200 abnormally moves. In this case, in the hanger trolley system according to an exemplary embodiment of the present disclosure, the hanger feeder 230 is not operated, and it is sensed that the hanger feeder 230 is not operated, thereby informing that the abnormality has been generated in the succession.

Figure 5:
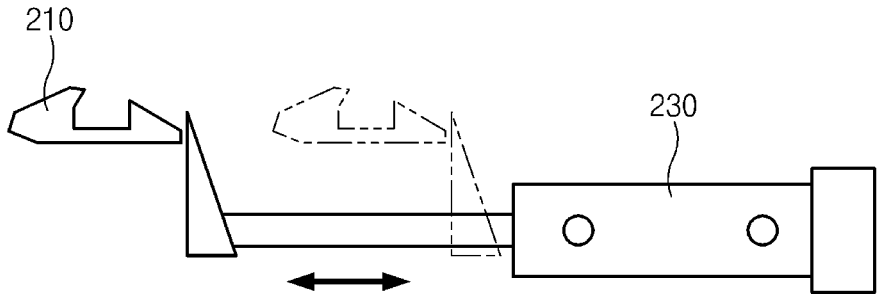
FIG. 5 is a view illustrating an operation of a hanger feeder provided in the hanger trolley system of FIG. 2.

In addition, as shown in FIG. 5, when the hanger feeder 230 is operated, the hanger dog 210 should move. However, when the hanger dog 210 does not move even though the hanger feeder 230 is operated, it is judged that the abnormality has been generated in the succession.

In the hanger trolley system according to an exemplary embodiment of the present disclosure, it is confirmed through the sensor 300 mounted on the linear module 220 whether the hanger trolley 200 is normally succeeded from the pre-process power rail to the post-process power rail.

The sensor 300 inspects a position, a posture, and a moving speed of the hanger dog 210 from a time in which the hanger feeder 230 starts to be operated up to a time in which the hanger dog 210 is separated from the chain dog 110 of the pre-process power rail and is completely coupled to a chain dog of the post-process power rail, in order to allow the hanger trolley 200, more specifically, the hanger dog 210 to be succeeded from the pre-process power rail to the post-process power rail.

Here, the acceleration sensor and the laser vision camera of the sensor 300 provided on the linear module 220 confirm whether the hanger feeder 230 provided in the hanger trolley 200 is normally operated, and inspect the position, the posture, and the moving speed of the hanger dog 210. This thereby confirms whether the hanger dog 210 is separated from the chain dog provided in the pre-process power rail and is in a state in which the hanger dog 210 may be coupled to the chain dog 110 provided in the post-process power rail.

In addition, the coupling between the hanger dog 210 and the chain dog 110 provided in the post-process power rail is confirmed through the laser vision camera mounted on the linear module 220. Therefore, the hanger trolley system according to an exemplary embodiment of the present disclosure may clearly perform the judgment on the succession when the hanger trolley 200 is succeeded from the pre-process power rail to the post-process power rail.

As described above, with the hanger trolley system according to an exemplary embodiment of the present disclosure as described above, the coupled state between the chain dog provided in the driving chain and the hanger dog provided in the hanger trolley is confirmed through the sensor, such that the judgment on the succession when the hanger trolley is succeeded from the pre-process driving chain to the post-process driving chain becomes clearer as compared with the related art.

In addition, since the judgment on the succession becomes clearer as compared with the related art, an accident such as separation of the hanger may be prevented.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A hanger trolley system comprising:

a driving chain provided in a power rail;

a hanger trolley having a hanger dog attached to and detached from a chain dog provided in the driving chain, a hanger feeder pushing the hanger dog from a pre-process power rail to a post-process power rail, and a linear module mounted on the hanger feeder to move along with the hanger dog when the hanger feeder pushes the hanger dog, wherein the hanger trolley moves along a free rail disposed below the power rail; and a sensor mounted on the linear module and sensing coupling between the chain dog and the hanger dog.

2. The hanger trolley system according to claim 1, wherein the sensor includes:

a laser vision camera photographing the chain dog and the hanger dog; and an acceleration sensor measuring a moving speed of the hanger trolley.

3. The hanger trolley system according to claim 2, further comprising a controller receiving measured signals from the laser vision camera and the acceleration sensor and transmitting a signal to a power source moving the driving chain.

4. The hanger trolley system according to claim 1, wherein the pre-process power rail passes the hanger trolley to the post-process power rail, and wherein the post-process power rail takes over the hanger trolley from the pre-process power rail.

5. The hanger trolley system according to claim 4, wherein the sensor is mounted on the linear module extended from the hanger feeder.

6. The hanger trolley system according to claim 4, wherein the sensor inspects a position, a posture, and a movement speed of the hanger dog.

7. The hanger trolley system according to claim 4, wherein the sensor operates from a time on which the hanger feeder starts to operate up to a time on which the hanger trolley is completely transferred from the pre-process power rail to the post-process power rail.

* * * * *